US011029017B2

(12) United States Patent
DeCarlo

(10) Patent No.: US 11,029,017 B2
(45) Date of Patent: Jun. 8, 2021

(54) STORAGE COMPARTMENT

(71) Applicant: Ryan Development Company, Norwood, NJ (US)

(72) Inventor: Therese DeCarlo, Norwood, NJ (US)

(73) Assignee: RYAN DEVELOPMENT COMPANY, Norwood, NJ (US)

( * ) Notice: Subject to any disclaimer, the term of this patent is extended or adjusted under 35 U.S.C. 154(b) by 421 days.

(21) Appl. No.: 16/162,173

(22) Filed: Oct. 16, 2018

(65) Prior Publication Data

US 2019/0110573 A1 Apr. 18, 2019

Related U.S. Application Data

(60) Provisional application No. 62/572,641, filed on Oct. 16, 2017.

(51) Int. Cl.

| | |
|---|---|
| ***F21V 33/00*** | (2006.01) |
| ***A45C 11/00*** | (2006.01) |
| ***A45C 15/06*** | (2006.01) |
| ***A45C 11/24*** | (2006.01) |
| ***A45C 15/04*** | (2006.01) |
| ***F21W 131/302*** | (2006.01) |

(52) U.S. Cl.

CPC ..... *F21V 33/004* (2013.01); *A45C 11/008* (2013.01); *A45C 15/06* (2013.01); *F21V 33/0004* (2013.01); *A45C 11/24* (2013.01); *A45C 15/04* (2013.01); *F21W 2131/302* (2013.01)

(58) Field of Classification Search

CPC ..... A45C 15/06; F21V 33/0004; A45D 33/32

See application file for complete search history.

(56) References Cited

U.S. PATENT DOCUMENTS

| | | | | | |
|---|---|---|---|---|---|
| 2,278,866 | A * | 4/1942 | Dell Elba | A45D 33/32 | 362/136 |
| 2,314,517 | A * | 3/1943 | Giacomo Pucci | A45D 33/32 | 362/137 |
| 3,217,154 | A * | 11/1965 | Owen | A45C 15/06 | 362/136 |
| 3,377,476 | A * | 4/1968 | Milam | A45C 15/06 | 362/136 |
| 3,381,119 | A * | 4/1968 | Brickman | A45C 15/06 | 362/137 |
| 3,381,120 | A * | 4/1968 | Stern | A45C 5/005 | 362/136 |
| 2004/0244811 | A1* | 12/2004 | Chen | A45D 33/18 | 132/301 |
| 2005/0231835 | A1* | 10/2005 | Tokushita | A45D 33/32 | 359/871 |

(Continued)

*Primary Examiner* — Alexander K Garlen

(57) ABSTRACT

A storage compartment for personal items consists of a first half shell, a second half shell, a separation panel, a hinging mechanism, a clamping mechanism, a mirror, and a lighting assembly. The first half shell and the second half shell are hingedly connected via the hinging mechanism. The clamping mechanism provides a locking mechanism to secure the personal items held within the first half shell and the second half shell. The separation panel can be used to organize personal items. In addition to mounting the mirror, the separation panel can also be used to mount a light source. Make-up items, tools, and other comparable items can be held within a structural body of both the first half shell and the second half shell.

9 Claims, 6 Drawing Sheets

(56) References Cited

U.S. PATENT DOCUMENTS

| | | | | |
|---|---|---|---|---|
| 2010/0182770 | A1* | 7/2010 | Huang | F21V 33/0004<br>362/137 |
| 2011/0061675 | A1* | 3/2011 | McKinley | A45D 33/24<br>132/296 |
| 2012/0162970 | A1* | 6/2012 | Bichrest | A45D 42/04<br>362/135 |
| 2014/0306587 | A1* | 10/2014 | Pun | A45D 33/32<br>312/226 |

* cited by examiner

STORAGE COMPARTMENT

The current application claims a priority to the U.S. Provisional Patent application Ser. No. 62/572,641 filed on Oct. 16, 2017.

FIELD OF THE INVENTION

The present invention relates generally to a personal storage container. More specifically, the present invention is a storage compartment that can be used to store a variety of personal items.

BACKGROUND OF THE INVENTION

Humans have been concerned with personal appearance for centuries. Each culture has developed unique styles over time, that are influenced by tradition, region and other factors. In modern times, cosmetic products are commonly used to hide or accentuate certain features. Applying these products is usually done by the user, however in some cases professional assistance may be required depending on the complexity of the procedure, or the event. Cosmetics are designed to be applied externally, and the products may have skin care properties, or esthetical enhancement capabilities. Maintaining a consistent appearance through the day can be an especially difficult task especially if the person has an active lifestyle or lives in an environment with harsh weather. Therefore, touchups and repairs are sometimes needed to sustain the initial look. Storing and carrying these products can be a laborious task, especially if the user chooses to transport them at all times on a daily basis.

Personal storage containers are commonly used for numerous purposes. People carry personal items, depending on their needs and lifestyle. Cell phones, keys, wallets, and personal hygiene items are just a few objects that a person may carry on a usual basis. Keeping personal items organized allows users to find objects quicker and more efficiently. Most make-up containers are portable. However, each of these objects has a specific configuration, and may serve a different purpose. The process of putting on make-up can vary depending on complexity, and the level of detail which the user desires however the process generally requires a few common tools to ensure the job can be done accurately and effortlessly. A light source and a mirror are usually needed to ensure the user is able to apply the cosmetics uniformly. Integrating all of the required accessories into a single compact carrying case, can lead to a bulky and heavy product that is laborious to transport. The present invention aims to solve some of these problems by disclosing a case which combines both functional and esthetical features. Even though the present invention is preferably used to carry make-up items, the present invention can also be used to carry other items such as supplements, hair ties, pens, and pencils.

DETAIL DESCRIPTIONS OF THE INVENTION

Figure 1:
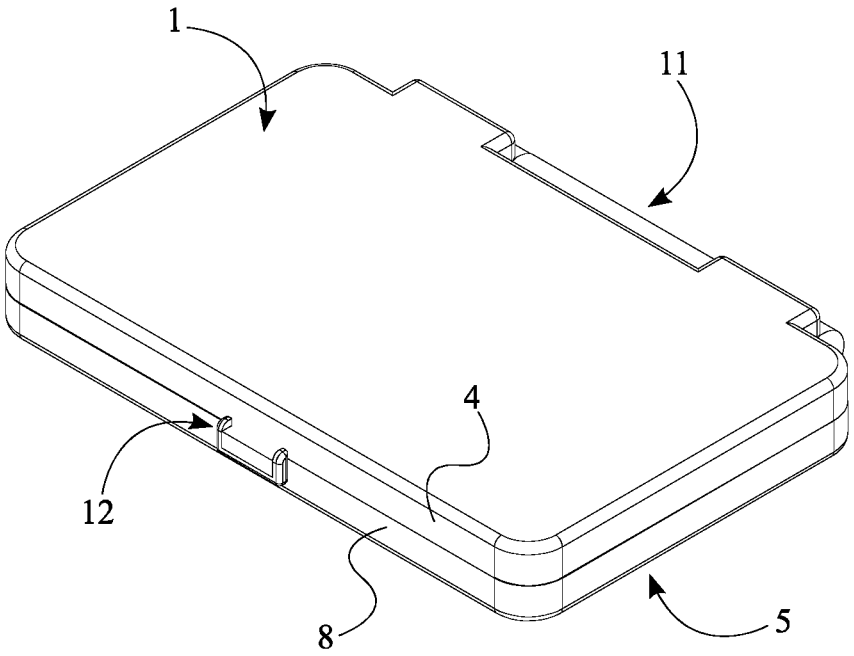
FIG. 1 is a perspective view of the present invention, wherein the present invention is in a closed configuration.

All illustrations of the drawings are for the purpose of describing selected versions of the present invention and are not intended to limit the scope of the present invention.

The present introduces a storage container for carrying personal items. The personal items that can be used with the present invention can be, but is not limited to, feminine products, hair supplies, supplements, medications, make-up, and jewelry. The overall shape and design of the present invention allows the user to organize the personal items as preferred.

As shown in FIGS. 1-6, to fulfill the intended functionalities, the present invention comprises a first half shell 1, a second half shell 5, a separation panel 9, a hinging mechanism 11, a clamping mechanism 12, a mirror 16, and a lighting assembly 100. The personal items of the user are stored within the first half shell 1 and the second half shell 5. The overall size and shape of the first half shell 1 and the second half shell 5 can vary in different embodiments of the present invention. Regardless of the size and shape, the first half shell 1 comprises a first-lengthwise edge 2, a structural body 3, and a second-lengthwise edge 4. Likewise, the second half shell 5 also comprises a first-lengthwise edge 6, a structural body 7, and a second-lengthwise edge 8. When considering the first half shell 1, the first-lengthwise edge 2 is positioned opposite the second-lengthwise edge 4 across the structural body 3. Similarly, the first-lengthwise edge 6 of the second half shell 5 is positioned opposite the second-lengthwise edge 8 across the structural body 7. The structural body 3 of the first half shell 1 extends from the first-lengthwise edge 2 to the second-lengthwise edge 4 and determines an overall width of the first half shell 1. The structural body 7 of the second half shell 5 extends from the first-lengthwise edge 6 to the second-lengthwise edge 8 and determines an overall width of the second half shell 5. The first half shell 1 and the second half shell 5 are manufactured from material that is durable and lightweight. In the preferred embodiment of the present invention, the first half shell 1 and the second half shell 5 are manufactured from polypropylene. However, the material used for the first half shell 1 and the second half shell 5, the color of the first half shell 1 and the second half shell 5, and other materialistic properties can vary in other embodiments of the present invention.

Figure 2:
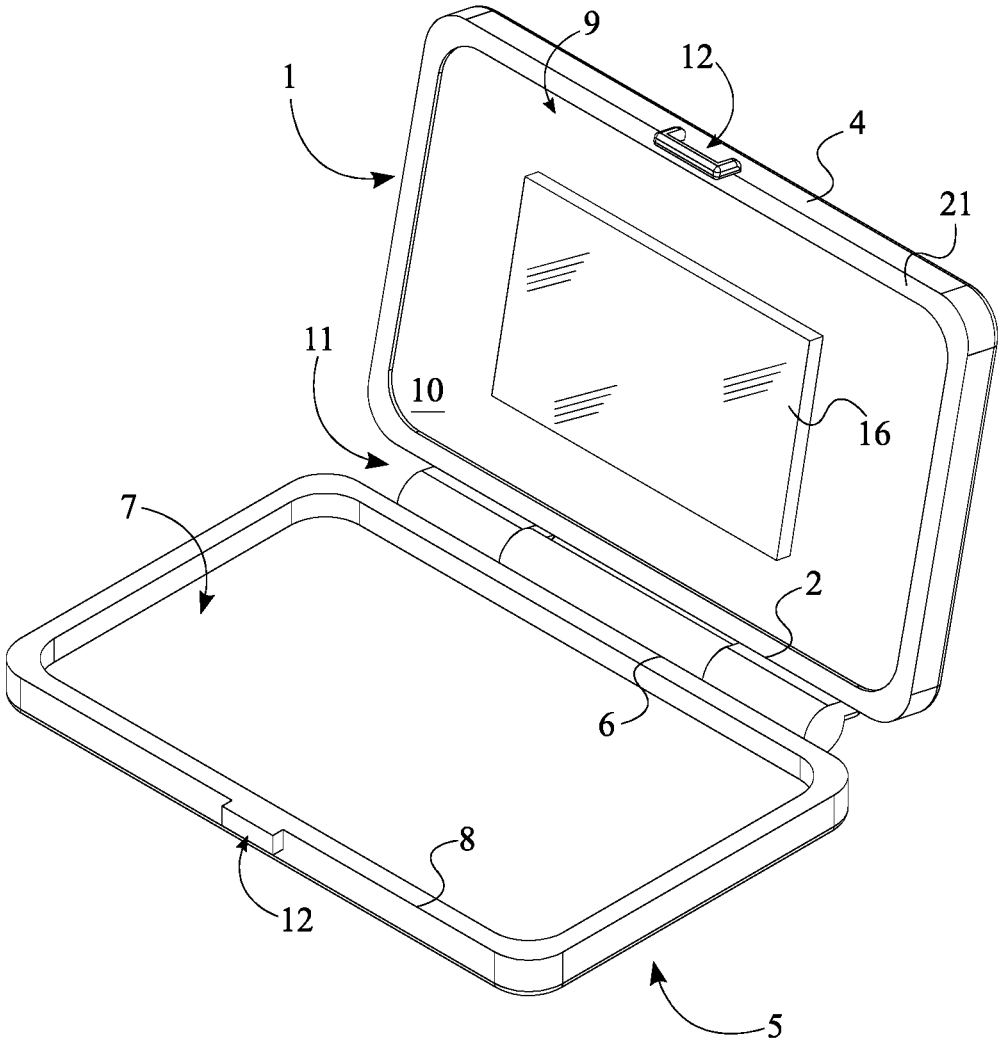
FIG. 2 is another perspective view of the present invention, wherein the present invention is in an open configuration.

To create a storage area with the first half shell 1 and the second half shell 5, the first-lengthwise edge 2 of the first half shell 1 is hingedly connected to the first-lengthwise edge 6 of the second half shell 5 with the hinging mechanism 11. The hinging mechanism 11 can be, but is not limited to, concealed hinges, spring hinges, and case hinges. As seen in FIG. 1 and FIG. 2, the hinging mechanism 11 allows the present invention to have an open configuration and a closed configuration. The user utilizes the open configuration to place and remove the personal items from within the present invention. On the other hand, the user utilizes the closed configuration to secure the personal items within the present invention. To secure content within the first half shell 1 and the second half shell 5, the second-lengthwise edge 4 of the first half shell 1 is detachably attached along the second-lengthwise edge 8 of the second half shell 5 with the clamping mechanism 12 which can vary in different embodiments of the present invention.

Figure 3:
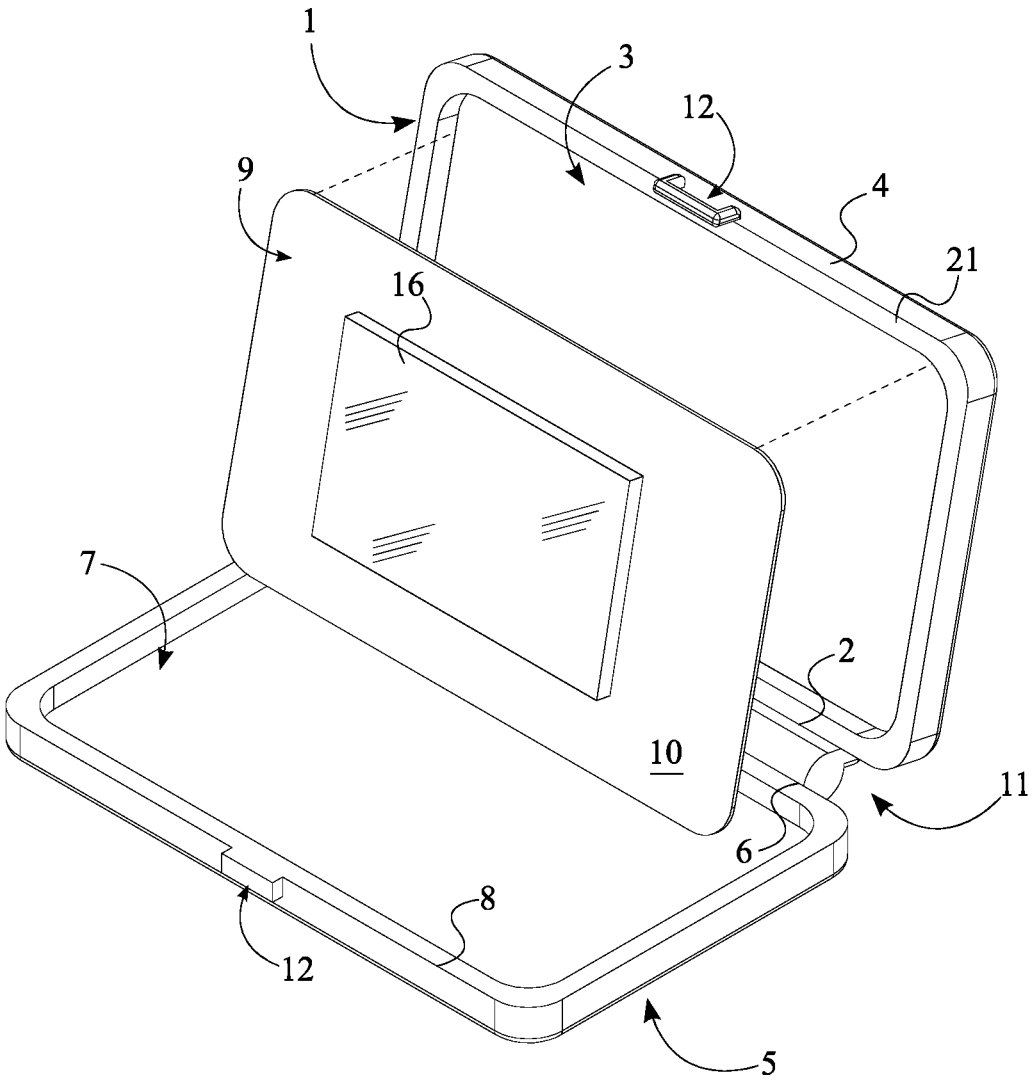
FIG. 3 is a perspective exploded view of the present invention.

The user might have a need to separate the personal items stored within the present invention. To do so, as seen in FIG. 2 and FIG. 3, in the preferred embodiment of the present invention, the separation panel 9 is mounted into the structural body 3 of the first half shell 1 adjacent a top edge 21 of the first half shell 1. However, in a different embodiment of the present invention, the separation panel 9 can be removably positioned into the structural body 3 of the first half shell 1. The materialistic properties of the separation panel 9 can vary from one embodiment to another. As an example, in one embodiment of the present invention, the separation panel 9 can be transparent so that the user can clearly view the personal items held separated by the separation panel 9. In another embodiment of the present invention, the separation panel 9 can be opaque so that the personal items separated by the separation panel cannot be seen. The mirror 16 is externally mounted onto the receiving surface 10 of the separation panel 9. If the present invention is being used to store make-up items, the mirror 16 can be used during the process of applying make-up.

Figure 4:
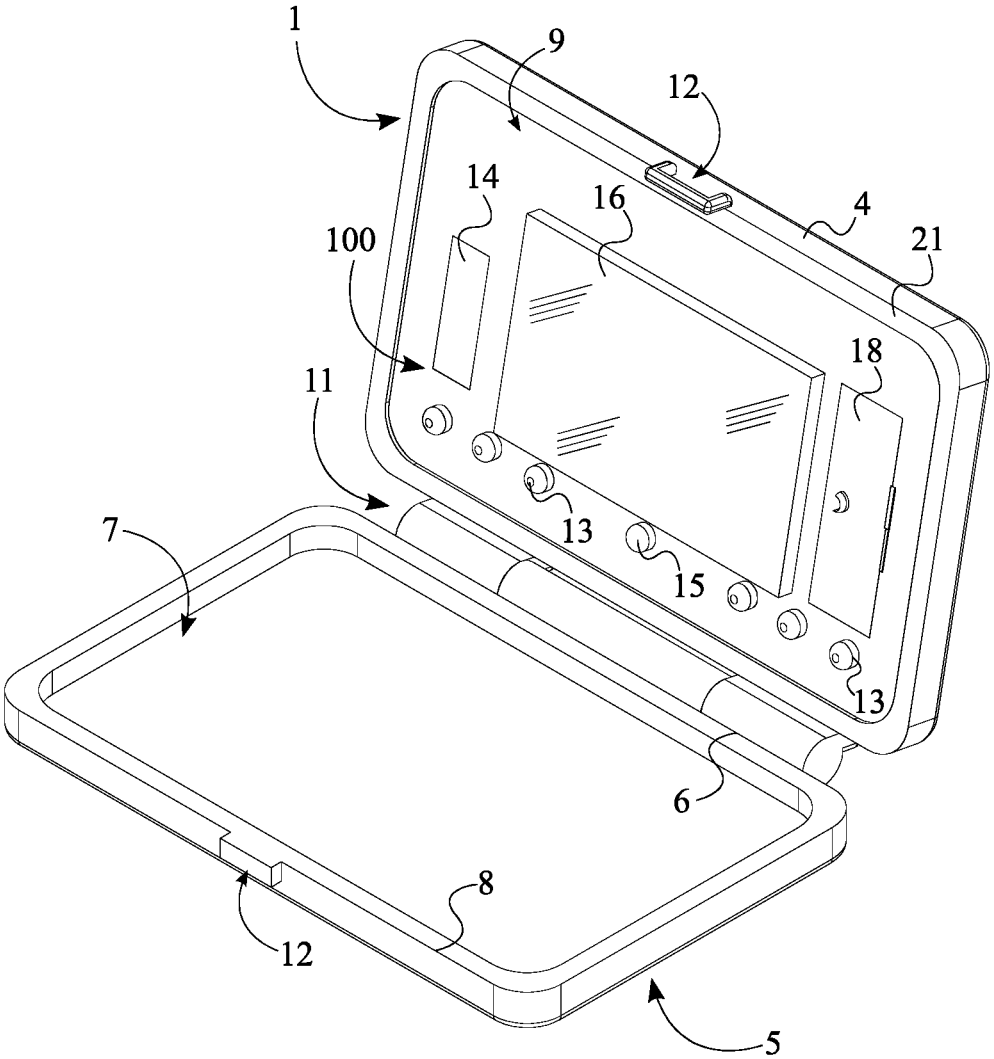
FIG. 4 is a perspective view of the present invention, wherein the mirror and the light source are illustrated.
Figure 5:
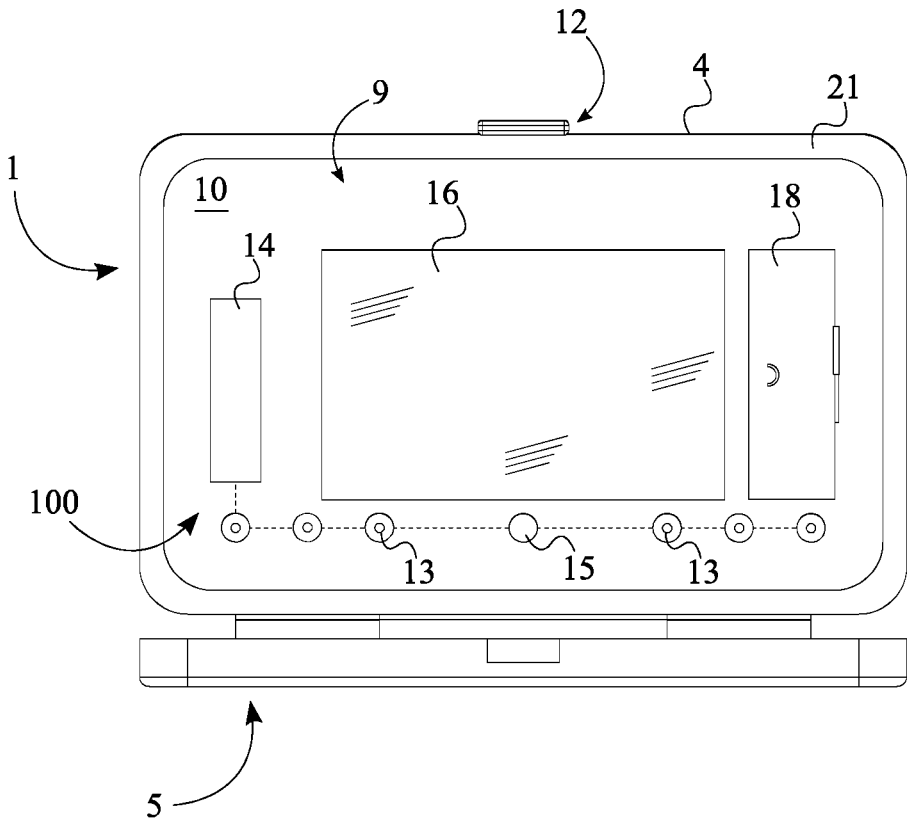
FIG. 5 is a front view of the present invention, wherein the mirror and the light source are illustrated.
Figure 6:
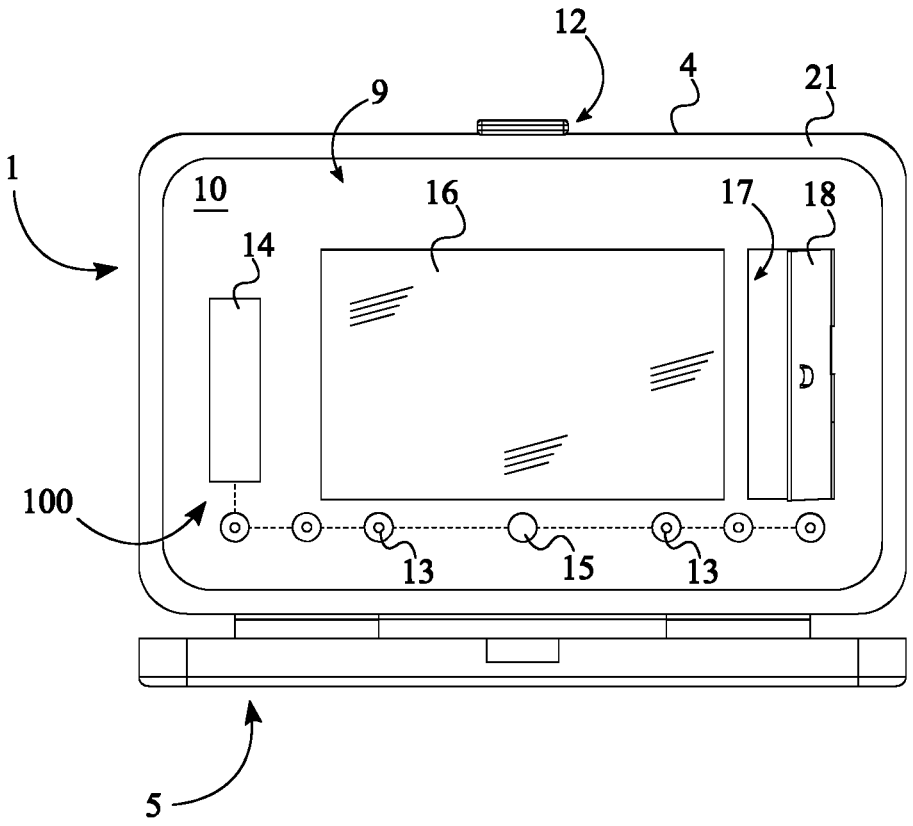
FIG. 6 is a front view of the present invention, wherein a compartment opening is illustrated.

The lighting assembly 100 is used to provide an external lighting source to the user. To do so, as seen in FIGS. 4-6, the lighting assembly 100 comprises a light source 13, a power source 14, and a switch 15. The light source 13, which is preferably at least one light-emitting diode (LED), can be used to view the personal items stored within the present invention. The power source 14 is electrically connected to the light source 13 through the switch 15 so that the illumination of the light source 13 can be controlled. The light source 13, the power source 14, and the switch 15 are externally mounted onto a receiving surface 10 of the separation panel 9. In the preferred embodiment of the present invention, the switch 15 is a pressure switch. Thus, the light source 13 is illuminated only when the present invention is in the open configuration. When the present invention is in the closed configuration, the light source 13 is switched off. If the present invention is used to carry make-up items, the light source 13 and the mirror 16 can be used to apply make-up during low-light conditions. Preferably, the light source 13 will be positioned adjacent the mirror 16.

As discussed before, the separation panel 9 can be used to organize the personal items stored within the present invention. As further illustrated in FIGS. 4-6, to access the personal items held in between the structural body 3 of the first half shell 1 and the separation panel 9, the present invention comprises a compartment opening 17 and a cover panel 18 in another embodiment of the present invention. The compartment opening 17 is positioned adjacent the mirror 16 and traverses through the receiving surface 10 of the separation panel 9. Thus, the user can access the personal items separated by the separation panel 9. The compartment opening 17 is secured with the cover panel 18 which is hingedly connected along a lateral edge of the compartment opening 17. The cover panel 18 will consist of a gripping protrusion that allows the user to control the position of the cover panel 18. Preferably, the gripping protrusion will be externally mounted onto the cover panel 18.

When the present invention is being used, the following process flow is generally followed. The personal items that need to be stored are initially selected. The space created by the separation panel 9 is used if a portion of the selected items needs to be separated from the remainder of the selected items. More specifically, the portion of selected items is positioned within the structural body 3 of the first half shell 1 and the separation panel 9. Next, the remainder of the selected items is placed within the structural body 7 of the second half shell 5. Finally, the present invention is positioned in the closed configuration such that the first half shell 1 and the second half shell 5 are detachably attached through the clamping mechanism 12. When the cover panel 18 and compartment opening 17 are used to access the personal items separated by the separation panel 9, the cover panel 18 is positioned in an open configuration so that the user can access the personal items separated by the separation panel 9. The personal items that can be stored within the present invention can be, but is not limited to, feminine products, hair supplies, supplements, jewelry, and make-up.

Although the invention has been explained in relation to its preferred embodiment, it is to be understood that many other possible modifications and variations can be made without departing from the spirit and scope of the invention as hereinafter claimed.

What is claimed is:

1. A storage compartment comprises:
- a first half shell;
- a second half shell;
- a separation panel;
- a hinging mechanism;
- a clamping mechanism;
- a mirror;
- a lighting assembly;
- the lighting assembly comprises a light source, a power source, and a switch;
- the first half shell and the second half shell each comprise a first-lengthwise edge, a structural body, and a second-lengthwise edge;
- the first-lengthwise edge being positioned opposite the second-lengthwise edge across the structural body;
- the first-lengthwise edge of the first half shell being hingedly connected to the first-lengthwise edge of the second half shell with the hinging mechanism;
- the second-lengthwise edge of the first half shell being detachably attached along the second-lengthwise edge of the second half shell with the clamping mechanism;
- the separation panel being mounted into the structural body of the first half shell adjacent a top edge of the first half shell;
- the mirror being mounted onto a receiving surface of the separation panel;
- the lighting assembly being mounted onto the receiving surface adjacent the mirror;
- the power source being electrically connected to the light source through the switch;
- the light source, the power source, and the switch being externally mounted onto the receiving surface adjacent the mirror;
- a compartment opening;
- a cover panel;
- the compartment opening traversing through a receiving surface of the separation panel;
- the compartment opening being positioned adjacent the mirror; and
- the cover panel being hingedly connected along a lateral edge of the compartment opening.

2. The storage compartment as claimed in claim 1, wherein the light source is at least one light-emitting diode.

3. The storage compartment as claimed in claim 1, wherein the switch is a pressure switch.

4. The storage compartment as claimed in claim 1, wherein the first half shell and the first half shell are manufactured from polypropylene.

5. A storage compartment comprises:

a first half shell;

a second half shell;

a separation panel;

a hinging mechanism;

a clamping mechanism;

a mirror;

a compartment opening;

a cover panel;

a lighting assembly;

the first half shell and the second half shell each comprise a first-lengthwise edge, a structural body, and a second-lengthwise edge;

the first-lengthwise edge being positioned opposite the second-lengthwise edge across the structural body;

the first-lengthwise edge of the first half shell being hingedly connected to the first-lengthwise edge of the second half shell with the hinging mechanism;

the second-lengthwise edge of the first half shell being detachably attached along the second-lengthwise edge of the second half shell with the clamping mechanism;

the separation panel being mounted into the structural body of the first half shell adjacent a top edge of the first half shell;

the mirror being mounted onto a receiving surface of the separation panel;

the lighting assembly being mounted onto the receiving surface adjacent the mirror;

the compartment opening traversing through a receiving surface of the separation panel;

the compartment opening being positioned adjacent the mirror; and the cover panel being hingedly connected along a lateral edge of the compartment opening.

6. The storage compartment as claimed in claim 5 further comprises:

the lighting assembly comprises a light source, a power source, and a switch;

the power source being electrically connected to the light source through the switch; and the light source, the power source, and the switch being externally mounted onto the receiving surface adjacent the mirror.

7. The storage compartment as claimed in claim 6, wherein the light source is at least one light-emitting diode.

8. The storage compartment as claimed in claim 6, wherein the switch is a pressure switch.

9. The storage compartment as claimed in claim 5, wherein the first half shell and the first half shell are manufactured from polypropylene.

* * * * *